US010310430B2

(12) United States Patent
Fukaya

(10) Patent No.: US 10,310,430 B2
(45) Date of Patent: Jun. 4, 2019

(54) IMAGE QUALITY STABILIZATION PROCESSING

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hideaki Fukaya, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/464,652

(22) Filed: Mar. 21, 2017

(65) Prior Publication Data

US 2018/0231930 A1 Aug. 16, 2018

(30) Foreign Application Priority Data

Feb. 13, 2017 (JP) ..... 2017-024327

(51) Int. Cl.

| | |
|---|---|
| ***G03G 15/00*** | (2006.01) |
| ***G03G 15/01*** | (2006.01) |
| ***G03G 15/043*** | (2006.01) |
| ***G03G 15/06*** | (2006.01) |
| ***G03G 15/20*** | (2006.01) |

(52) U.S. Cl.

CPC ..... *G03G 15/5058* (2013.01); *G03G 15/55* (2013.01); *G03G 15/6585* (2013.01); *G03G 15/0126* (2013.01); *G03G 15/0189* (2013.01); *G03G 15/043* (2013.01); *G03G 15/065* (2013.01); *G03G 15/205* (2013.01)

(58) Field of Classification Search

CPC ..... G03G 15/5062; G03G 15/01
USPC ..... 399/39
See application file for complete search history.

(56) References Cited

U.S. PATENT DOCUMENTS

2011/0286018 A1* 11/2011 Hashizume ..... G03G 15/0178 358/1.9
2012/0008993 A1* 1/2012 Maeda ..... G03G 15/0131 399/301
2014/0255054 A1* 9/2014 Katayama ..... G03G 15/2039 399/69

FOREIGN PATENT DOCUMENTS

JP 2010-276664 12/2010

* cited by examiner

*Primary Examiner* — Gregory H Curran
(74) *Attorney, Agent, or Firm* — Amin, Turocy & Watson LLP

(57) ABSTRACT

According to one embodiment, there is provided an image forming apparatus including an image forming unit and a controller. The image forming unit is able to execute a first image formation processing using a first color material and a second image formation processing using a second color material. The controller performs image quality stabilizing processing for the first image formation processing using second color material.

4 Claims, 3 Drawing Sheets

| CLASSIFICATION | CONTROL TEMPERATURE RANGEOF FIXING DEVICE [°C] |
|---|---|
| FIXING FEASIBLE TEMPERATURE OF DECOLORABLE TONER | 150~160 |
| FIXING FEASIBLE TEMPERATURE OF NON-DECOLORABLE TONER | 170~180 |
| DECOLORABLE TEMPERATURE OF DECOLORABLE TONER | 190~200 |

IMAGE QUALITY STABILIZATION PROCESSING

CROSS-REFERENCE TO RELATED APPLICATIONS

This application is based upon and claims the benefit of priority from Japanese Patent Application No. 2017-024327, filed Feb. 13, 2017, the entire contents of which are incorporated herein by reference.

FIELD

Embodiments described herein relate generally to image quality stabilizing processing.

BACKGROUND

In the image forming apparatus, a photoconductive drum may be changed with time or relative positional deviation between respective components may occur due to an increase of temperature in an apparatus. In the image forming apparatus, when such situations occur, respective images are deviated from a reference position, a reference magnification, and a reference concentration, positional deviation or concentration deviation may be caused between respective color images overlapped with each other.

For that reason, the image forming apparatus performs image quality stabilizing processing which corresponds to position adjustment processing and concentration adjustment processing of respective color images at the time of warming up, or the like. The image forming apparatus forms, for example, test pattern of respective colors on a transfer belt, detects the test patterns by an image quality maintaining sensor, and corrects position and concentrations of respective color images based on the measured result.

In the image forming apparatus, image formation using a decolorable toner and a non-decolorable toner can be selectively conducted (for example, see JP-A-2014-174317).

DETAILED DESCRIPTION

In the apparatus disclosed in JP-A-2014-174317, when a temperature of a fixing device exceeds an upper limit temperature at the time of image formation processing using the decolorable toner, image quality stabilizing processing using the decolorable toner is performed by using a time until the temperature of the fixing device is cooled down to less than or equal to the upper limit temperature. In the apparatus, even when the temperature of the fixing device exceeds the upper limit temperature at the time of image formation processing using a non-decolorable toner, similarly, image quality stabilizing processing using the non-decolorable toner is performed by using a time until the temperature of the fixing device is cooled down to less than or equal to the upper limit temperature.

In the apparatus disclosed in JP-A-2014-174317, although the execution time of image quality stabilizing processing is improved, improvement is needed from various standpoints relating to image quality stabilizing processing.

An object of exemplary embodiments described herein is to provide a technology for improving image quality stabilizing processing.

In general, according to one embodiment, an image forming apparatus includes an image forming unit and a controller. The image forming unit is able to conduct first image formation processing using a first color material and second image formation processing using a second color material. The controller performs image quality stabilizing processing for first image formation processing using the second color material.

In the following, respective exemplary embodiments will be described based on the accompanying drawings.

Figures 1, 2:
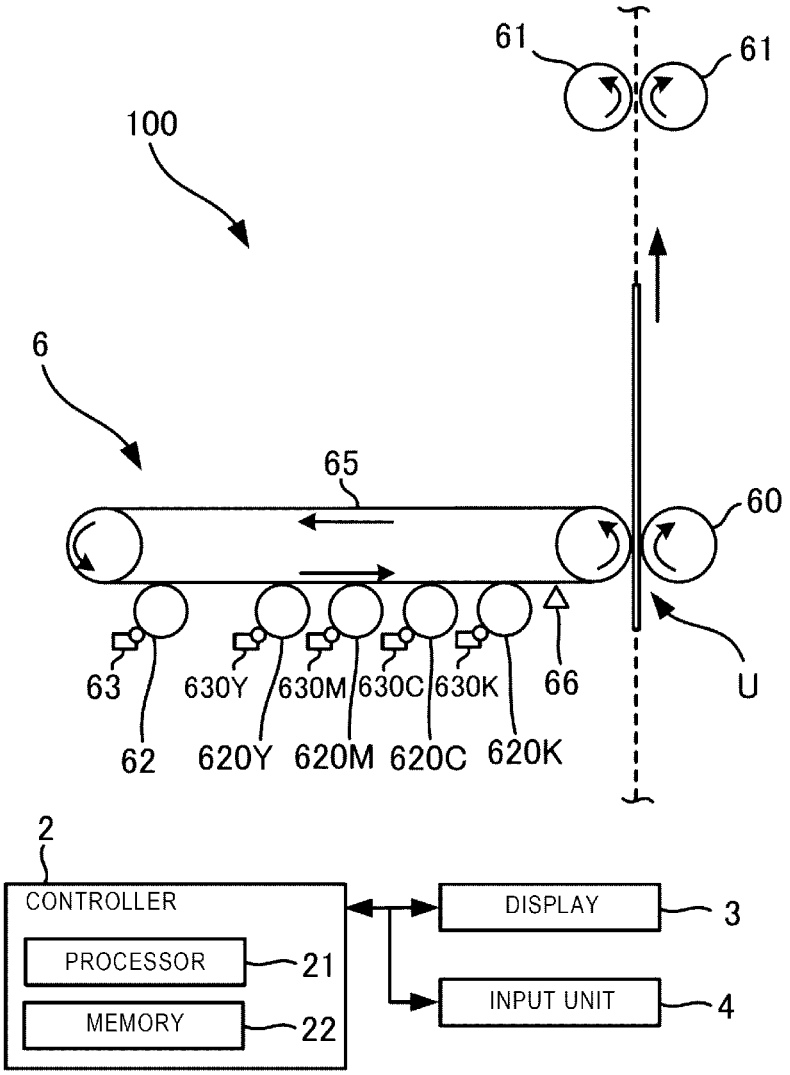
FIG. 1 illustrates a schematic diagram of an image forming apparatus.
FIG. 2 illustrates a diagram of a control temperature range of a fixing device.

FIG. 1 illustrates a schematic diagram of an image forming apparatus 100. The image forming apparatus 100 is a multi-function peripheral (MFP) having a plurality of functions such as copying, printing, scanning, FAX transmission, Email transmission, or the like.

The image forming apparatus 100 includes an image forming unit 6. The image forming unit 6 is able to conduct first image formation processing for transferring an image formed on a sheet with a decolorable toner (first color material) and second image formation processing for transferring an image formed on a sheet with a non-decolorable toner (second color material).

In the exemplary embodiment, the decolorable toner is utilized as a color material for decolorization with which an image formed on the sheet with the color material through decolorization processing, in which the sheet is heated is decolorized. The color material for decolorization includes a color developing compound, a color developer, and a decolorizing agent. The color developing compound may include, for example, a leuco dye colored by blue. The color developer may include, for example, a phenolicmaterial. The decolorizing agent may include a substance which is dissolved with the color developing compound when being heated and which does not have affinity with the color developer. The color material for decolorization develops color through interaction of the color developing compound with the color developer and is decolored by the result that the interaction of the color developing compound with the color developer is ended by being heated to greater than or equal to a decolorization temperature.

Decolorizing ink may be used as the color material for decolorization. In this case, the image forming unit 6 forms an image on the sheet not by an electrophotographic method using photoconductive drums 620Y to 620K and 62, which will be described later, but by an ink jet method, that is, forms an image on the sheet by ejecting the decolorizing ink from ink jet head.

In the present exemplary embodiment of the present disclosure, the image forming apparatus 100 uses only a blue decolorable toner. The image forming apparatus 100 may be configured to use decolorable toner of Y (yellow), M (magenta), C (cyan), K (black) of four colors.

In the present exemplary embodiment of the present disclosure, the image forming apparatus 100 uses the non-decolorable toner as the color material for non-decolorization which maintains coloring even when being subjected to decolorization processing. As the non-decolorable toner, a non-decolorable toner of four colors of Y (yellow) to K (black) is used. The image forming apparatus 100 may be configured to use only the non-decolorable toner of K (black).

The term "decoloring" means that an image formed with color (including achromatic color such as white and black as well as chromatic color) different from color of under-layer of the sheet is not allowed to be visually seen or is made hardly visible. The expression "not allowing an image to be visually seen" means that color of an image formed with color different from color of under-layer of the sheet is discolored to color which is the same or similar to the color of under-layer of the sheet in addition to a situation that the image formed with color different from color of under-layer of the sheet loses a color (transparent).

In the image forming unit 6, the developing devices 630Y to 630K use non-decolorable toners of Y to K in development and the developing device 63 uses a blue decolorable toner in development.

The photoconductive drums 620Y to 620K and the developing devices 630Y to 630K are present between the photoconductive drum 62 and the developing device 63, and the secondary transfer position U in a rotation direction of the transfer belt 65 (counterclockwise direction in FIG. 1). The secondary transfer position U is a position where nip is formed between the secondary transfer roller 60 and the transfer belt 65. Positions of the photoconductive drum 62 and the developing device 63 may be changed with positions of the photoconductive drums 620Y to 620K and the developing device 630Y to 630K to be reversed.

The image forming unit 6 forms an electrostatic latent image on the photoconductive drums 620Y to 620K and 62 by a light source (not illustrated) such as a light emitting diode (LED) or a laser unit and develops the electrostatic latent image formed by the developing device 630Y to 630K and 63 using the non-decolorable toner or the decolorable toner. The image forming unit 6 takes out a sheet from a first cassette (not illustrated) and sends the sheet to a secondary transfer position U. The image forming unit 6 transfers the developed toner image on the sheet through transfer belt 65 at the secondary transfer position U.

The image forming apparatus 100 sends the sheet on which the toner image is formed to the fixing device 61. The fixing device 61 includes a pair of rollers which is in contact with both sides of the sheet and controls the temperature of the pair of the rollers. The image forming apparatus 100 heats the sheet by the fixing device 61 and fixes the toner image on the sheet.

The image forming apparatus 100 is able to heat the sheet to conduct decolorization processing for decolorizing the image on the sheet. In this case, the image forming apparatus 100 takes out the sheet on which an image is formed with the decolorable toner from a second cassette (not illustrated) in which the sheet is stacked and sends the sheet to the fixing device 61. The image forming apparatus 100 heats the sheet from the fixing device 61 and decolorizes the image on the sheet.

The image forming apparatus 100 includes a controller 2, a display 3, and an input unit 4. The controller 2 controls the entirety of the image forming apparatus 1. The controller 2 includes a processor 21 and a memory 22 (storage region). The processor 21 reads a program within the memory 22 and performs various processing. The display 3 is a touch panel or the like and displays setting information, an operation status, log information, or a notification to a user of the image forming apparatus 100. The input unit 4 is a button, a key, or a touch panel. The input unit 4 receives an input by a user and receives instructions of functional operations of the image forming apparatus 100 such as printing instruction or an input for setting.

The image forming unit 6 includes an image quality maintaining sensor 66. The image quality maintaining sensor 66 opposes an area between the photoconductive drum 2K and the secondary transfer position U in the rotation direction of the transfer belt 65 in the transfer belt 65. The image quality maintaining sensor 66 is a reflection type sensor including a photodiode or the like. A plurality of the image quality maintaining sensors 66 are installed in a main scanning direction orthogonal to the advancing direction of the transfer belt 65. Each position of the image quality maintaining sensors 66 in the main scanning direction corresponds to each position of the test pattern, which are formed at the time of image quality stabilizing processing, in the main scanning direction. A region in which the test patterns are formed is irradiated with light by the image quality maintaining sensors 66 in the transfer belt 65 and each image quality maintaining sensor 66 outputs a voltage according to an amount of light reflected from the test pattern to the controller 2.

The controller 2 forms V-shaped test patterns of Y (yellow) to K (black) with the non-decolorable toner along a sub-scanning direction, which is the advancing direction of the transfer belt 65, in the transfer belt 65 at the time of positional deviation adjustment processing for second image formation processing using the non-decolorable toner. The controller 2 forms a single set of the test patterns by arranging two sets of the test patterns in the main scanning direction. The controller 2 detects the positions, the shapes, or the concentrations of the test patterns by the image quality maintaining sensors 66. The controller 2 calculates inclination deviation from a reference angle, magnification deviation from a reference size, and sub-scanning direction deviation (parallelism deviation) of the test pattern between respective rows and corrects, for example, write positions to the photoconductive drums 620Y to 620K at the time of second image formation processing.

The controller 2 forms the test patterns of Y (yellow) to K (black) which are patch images formed with the non-decolorable toner on the transfer belt 65 along the main scanning direction at the time of concentration deviation adjustment processing for second image formation processing using the non-decolorable toner. The controller 2 detects concentrations of a plurality of points of each test pattern and calculates an average value of detected values. When a difference between the concentration and a target value of the test pattern is not within a prescribed range, the controller 2 adjusts the developing bias to be applied to the photoconductive drums 620Y to 620K at the time of second image formation processing. With this, the controller 2 adjusts the adhesion amount of the toner to the photoconductive drum 620Y to 620K and corrects a concentration of an image.

The controller 2 basically performs processing similar to image quality stabilizing processing for second image formation processing described above even at the time of image quality stabilizing processing for first image formation processing using the decolorable toner. However, in the present exemplary embodiment of the present disclosure, the non-decolorable toner is equipped in the image forming apparatus 100 allowed to be used for only a single color and thus, the controller 2 basically forms the test patterns with one color component at the time of image quality stabilizing processing for first image formation processing using the non-decolorable toner.

FIG. 2 illustrates a diagram of a control temperature range of a fixing device 61. The control temperature of the fixing device 61 at the time of second image formation processing using the decolorable toner is a temperature (fixing feasible temperature) at which the decolorable toner is able to be fixed on the sheet and is 150° C. to 160° C. The control temperature of the fixing device 61 at the time of first image formation processing using the non-decolorable toner is a temperature (fixing feasible temperature) at which the non-decolorable toner is able to be fixed on the sheet and is 170° C. to 180° C. The control temperature of the fixing device 61 at the time of decolorization processing is a temperature (decolorable temperature) at which the decolorable toner is able to be decolorized on the sheet and is 190° C. to 200° C. The decolorable temperature is higher than the fixing temperature of the non-decolorable toner and the fixing temperature of the decolorable toner. The non-decolorable toner is not decolorized and maintains coloring at the decolorable temperature.

Figure 3:
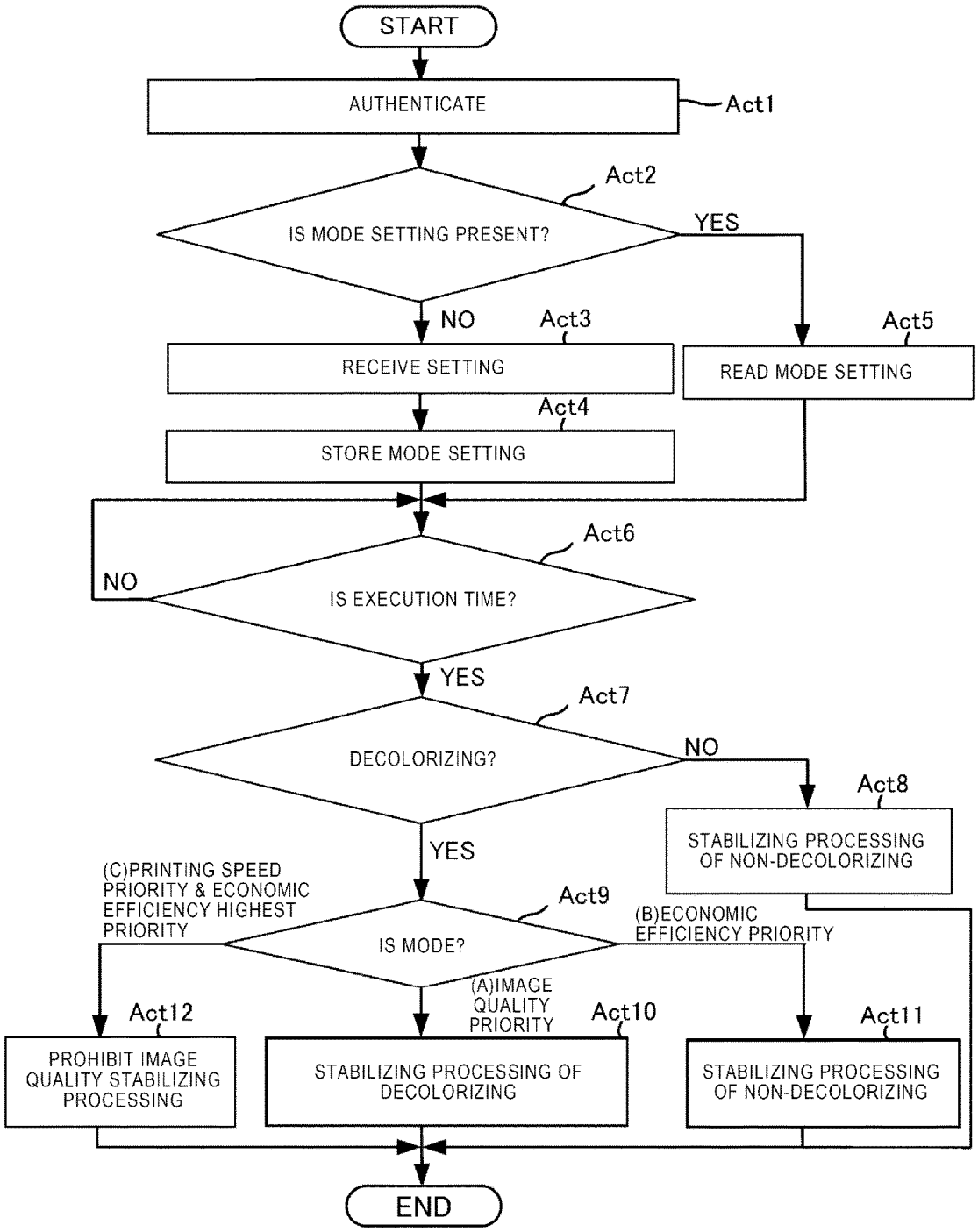
FIG. 3 illustrates a flowchart of image quality stabilizing processing.

In the following, image quality stabilizing processing by the controller 2 of the image forming apparatus 100 will be described with reference to a flowchart of FIG. 3. The controller 2 reads a program within the memory 22 to execute image quality stabilizing processing.

The controller 2 places a card on a card reading unit (not illustrated) or the like, acquires identifying information of the user, and performs user authentication to approve the user (Act1).

When mode setting which is mode setting of image quality stabilizing processing for first image formation processing using the decolorable toner and is correlated with the user is not present in the memory 22 (Act2: NO), the controller 2 performs the following two processes of Act3 and Act 4.

Figure 4:
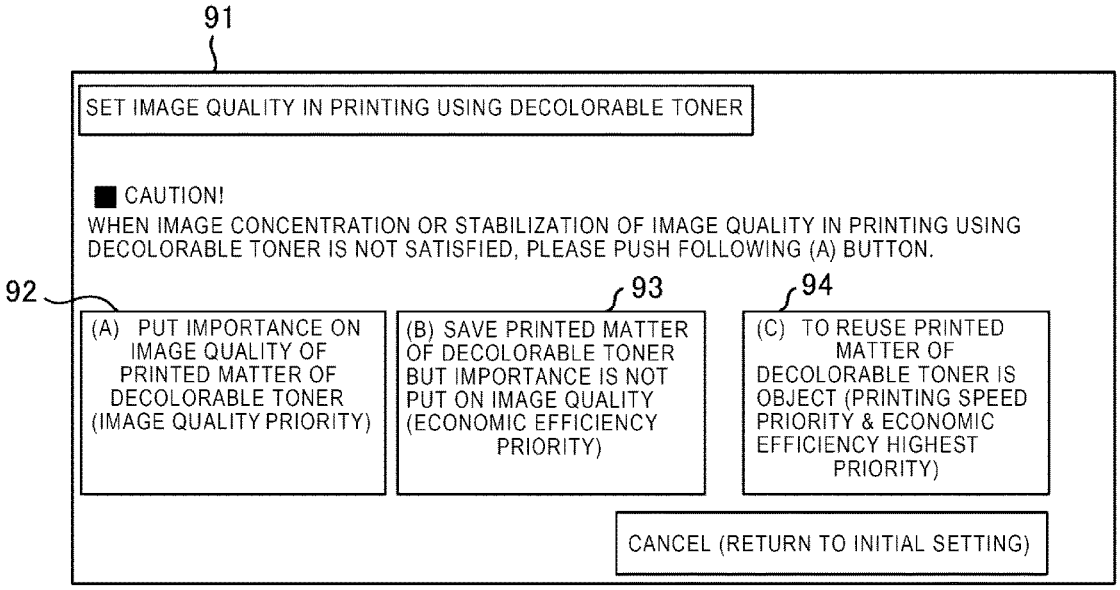
FIG. 4 illustrates a mode setting screen.

FIG. 4 illustrates a mode setting screen 91.

The controller 2 displays the mode setting screen 91 on the display 3 and receives mode setting of image quality stabilizing processing for first image formation processing using the decolorable toner (Act3). As modes of the mode setting, there are an image quality priority mode (first mode), an economic efficiency priority mode (second mode), and an economic efficiency highest priority mode (third mode).

In the image quality priority mode, an image quality of printed matter with the decolorable toner takes precedence over economic efficiency or a printing speed. When a button 92 is pushed on the mode setting screen 91, the controller 2 sets an image quality priority mode. When the image quality priority mode is set, the controller 2 performs image quality stabilizing processing for first image formation processing, which uses the decolorable toner, using the decolorable toner. The controller 2 forms the test patterns using the decolorable toner at the time of image quality stabilizing processing.

As such, in the image quality priority mode, image quality stabilizing processing using the decolorable toner is performed and thus, it is possible to perform an image quality adjustment with high precision and on the other hand, costs much, compared to an economic efficiency priority mode, which will be described later, in which image quality stabilizing processing is performed using the non-decolorable toner. In the image quality priority mode, image quality stabilizing processing is performed when the number of copied sheets reaches the number of sheets for copying or the like and thus, the printing speed may be delayed (it takes time until the completion of printing), compared to an economic efficiency highest priority mode, which will be described later, in which image quality stabilizing processing is prohibited.

The economic efficiency priority mode is a mode which is for a user who plans to save and use printed matter with the decolorable toner but does not attach importance on an image quality. The controller 2 sets the economic efficiency priority mode when a button 93 is pushed on the mode setting screen 91. When the economic efficiencypriority-mode is set, the controller 2 performs image quality stabilizing processing for first image formation processing, which uses the decolorable toner, using the non-decolorable toner. That is, the controller 2 forms the test patterns using the non-decolorable toner at the time of image quality stabilizing processing.

As such, in the economic efficiency priority mode, image quality stabilizing processing for first image formation processing is performed using the decolorable toner using the non-decolorable toner cheaper than the decolorable toner. For example, the controller 2 forms the test patterns using the non-decolorable toner of K which is the cheapest, among the non-decolorable toners of Y to K, without using the decolorable toner at the time of positional deviation adjustment processing for first image formation processing using the decolorable toner. The controller 2 detects the positions, the shapes, and the concentrations of the test patterns, calculates the magnification deviation, inclination deviation, or the like, and corrects the write position to the photoconductive drum 62 or the like. In this case, the controller 2 uses the non-decolorable toner of K without using the decolorable toner and thus, the measured result with the non-decolorable toner of K may be corrected so that the measured result with the non-decolorable toner of K is to correlated with the measured result of the decolorable toner.

In the economic efficiency priority mode, image quality stabilizing processing is performed using a cheap non-decolorable toner and thus, it is possible to reduce the cost than the image quality priority mode at which the decolorable toner is used for image quality stabilizing processing.

The economic efficiency highest priority mode is a mode for a user who plans to perform decolorization processing to reuse printed matter with the decolorable toner. When a button 94 is pushed on the mode setting screen 91, the controller 2 sets the economic efficiency highest priority mode. When the economic efficiency highest priority mode is set, the controller 2 prohibits image quality stabilizing-processing for first image formation processing using the decolorable toner. Accordingly, in the economic efficiency highest priority mode, image quality stabilizing processing is not performed and thus, the printing speed is faster and toner consumption is smaller than the image quality priority mode and the economic efficiency priority mode at which image quality stabilizing processing is performed, thereby capable of reducing the cost.

The controller 2 stores the mode setting received from the user in the memory 22 in correlation with the user (Act4).

When the mode setting correlated with the user of image quality stabilizing processing for first image formation processing is present within the memory 22 (Act2: YES), the controller 2 reads the mode setting from the memory 22 and sets as a mode of the mode setting (Act5).

The controller 2 determines whether it is the execution time of image quality stabilizing processing (Act6). The controller 2 determines that it is the execution time of image quality stabilizing processing, for example, at the time of warming up (at the time of startup), when the number of copied sheets reaches the number of specified sheets for copying, and when an accumulated time of Ready mode at which a job is received reaches a prescribed time.

The controller 2 counts the accumulated number of copied sheets for each of first image formation processing using the decolorable toner and each of second image formation processing using the non-decolorable toner and determines that image quality stabilizing processing for first image formation processing and second image formation processing, of which the number of copied sheets reaches the number of specified sheets for copying, reach the execution time. Whether which of image quality stabilizing processing of first image formation processing or second image formation processing is to be performed at the time of warming up or when the accumulated time of Ready mode reaches a prescribed time is set in advance and may be arbitrarily set by the user.

When it is determined that it is the execution time of image quality stabilizing processing for second image formation processing using the non-decolorable toner (Act6: YES, Act7: NO), the controller 2 performs image quality stabilizing processing using the non-decolorable toner (Act8).

When it is determined that it is the execution time of image quality stabilizing processing for first image formation processing using the decolorable toner (Act6: YES, Act7: YES), the controller 2 performs the following Act10 when the image quality priority mode is set (Act9: (A)).

The controller 2 forms the test patterns with the decolorable toner and performs image quality stabilizing processing using the decolorable toner in image quality stabilizing processing for first image formation processing using the decolorable toner (Act10).

When it is determined that it is the execution time of image quality stabilizing processing for first image formation processing using the decolorable toner (Act6: YES, Act7: YES), the controller 2 performs the following Act11 when the economic efficiency priority mode is set (Act9: (B)).

The controller 2 forms the test patterns using the non-decolorable toner and performs image quality stabilizing processing using the non-decolorable toner in image quality stabilizing processing for first image formation processing using the decolorable toner (Act11). Image quality stabilizing processing is generally performed using the decolorable toner and in the exemplary embodiment of the present disclosure, image quality stabilizing processing is performed using the non-decolorable toner cheaper than the decolorable toner and thus, the cost can be reduced.

When it is determined that it is the execution time of image quality stabilizing processing for first image formation processing using the decolorable toner (Act6: YES, Act7: YES), the controller 2 prohibits image quality stabilizing processing (Act12) and does not perform image quality stabilizing processing, when the economic efficiency highest priority mode is set (Act9: (C)).

In the exemplary embodiment of the present disclosure, by adopting the configuration as described above, it is possible to further prevent degradation of the decolorable toner which is relatively expensive as much as possible compared to the related art and it is possible to prolong consumable article life of an image forming unit related to the decolorable toner.

MODIFIED EXAMPLE

The controller 2 may perform image quality stabilizing processing for first image formation processing, which uses the first color material, by using a second color material. For example, when the remaining amount of the first non-decolorable toner of Y to K becomes to less than or equal to a set value, the controller 2 may perform image quality stabilizing processing for first image formation processing, which uses a first non-decolorable toner, by using a second non-decolorable toner (second color material) of Y to K which is different from the first non-decolorable toner(first color material) of which the remaining amount becomes less than or equal to the set value. The controller 2 may adjust a developing bias of the photoconductive drum 620Y to 620K for the first non-decolorable toner or adjust the write position, based on the measured result, in first image formation processing using the first non-decolorable toner.

The controller 2 may perform image quality stabilizing processing for first image formation processing using the first non-decolorable toner of Y to K using the cheapest second non-decolorable toner or the second non-decolorable toner of which the remaining amount is the largest among the second non-decolorable toners different from the first non-decolorable toner.

The controller 2 may perform image quality stabilizing processing for second image formation processing using the non-decolorable toner using the decolorable toner.

The controller 2, as disclosed in JP-A-2014-174317, may perform image quality stabilizing processing for first image formation processing, which uses the decolorable toner using the non-decolorable toner, using the time until the temperature of the fixing device 61 is cooled down to less than or equal to the upper limit temperature when the temperature of the fixing device 61 exceeds an upper limit of the fixing feasible temperature at the time of first image formation processing using the decolorable toner.

The controller 2 may perform image quality stabilizing processing for second image formation processing, which uses the non-decolorable toner, using the non-decolorable toner using the time until the temperature of the fixing device 61 is cooled down to less than or equal to the upper limit temperature, at the time of second image formation processing using the non-decolorable toner, similar to when the temperature of the fixing device 61 exceeds an upper limit of the fixing feasible temperature.

In the exemplary embodiment, it is possible to provide a technology for improving image quality stabilizing processing.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming unit configured to conduct first image formation processing using a first single color material and second image formation processing using a second multicolor (Y,M,C,K) material; and a controller configured to perform image quality stabilizing processing for first image formation processing, wherein the image quality stabilizing processing operations performed by the controller further comprise:

conducting a second image processing to print a test pattern using a black (K) color of the second multicolor material;

detecting a position, a shape and a concentration of the test pattern;

calculating a magnification deviation and inclination deviation of the test pattern from a predefined model; and correcting a write position of a drum associated with the imaging forming unit on which the first image formation processing is conducted based on the magnification deviation and the inclination deviation, wherein the controller receives a setting which indicates whether image quality stabilizing processing for first image formation processing is to be performed in either a first mode using the first color material or a second mode using the second multicolor material, wherein the first mode is an image quality priority mode, and the second mode is an economic efficiency priority mode.

2. The apparatus according to claim 1, wherein the first color material is color material for decolorization with which an image formed using the first color material is decolorized through decolorization processing of heating of a sheet, and the second multicolor material is color material for non-decolorization which develops color even being subjected to decolorization processing.

3. The apparatus according to claim 1, wherein the controller receives a setting which indicates whether image quality stabilizing processing for first image formation processing is to be performed in any one of the first mode, the second mode, and a third mode at which execution of image quality stabilizing processing is prohibited.

4. The apparatus according to claim 1, wherein when the user is approved, the controller acquires mode setting of a user in image quality stabilizing processing for first image formation processing from a storage region.

* * * * *